United States Patent [19]

Hogan

[11] Patent Number: 4,951,488

[45] Date of Patent: Aug. 28, 1990

[54] KEYHOLDER

[76] Inventor: Joe R. Hogan, 8014 Bromley, Houston, Tex. 77055

[21] Appl. No.: 405,648

[22] Filed: Sep. 11, 1989

[51] Int. Cl.[5] ..... A44B 15/00

[52] U.S. Cl. ..... 70/456 R; 70/456 B

[58] Field of Search ..... 70/456 R–459

[56] References Cited

U.S. PATENT DOCUMENTS

| | | | |
|---|---|---|---|
| 1,522,607 | 1/1925 | Anderson . | |
| 1,621,796 | 3/1927 | Lorber | 70/456 B |
| 1,719,129 | 7/1929 | Miles | 70/456 B X |
| 1,999,660 | 4/1935 | Mosely et al. | 206/46 |
| 2,066,526 | 1/1937 | Gladstone | 70/456 R X |
| 2,078,293 | 4/1937 | Smith, Jr. et al. | 70/456 R |
| 2,228,726 | 1/1941 | Loesch | 70/456 B X |
| 2,596,716 | 5/1952 | Otten | 70/456 |
| 2,629,251 | 2/1953 | Schwalberg | 70/457 |
| 2,728,501 | 12/1955 | Hill | 225/28 |
| 2,734,624 | 2/1956 | Kernicki | 206/38 |
| 2,846,866 | 8/1958 | Hill | 70/456 |
| 3,279,513 | 10/1966 | Henderson | 150/40 |
| 3,280,967 | 10/1966 | Bergh et al. | 206/37 |
| 3,456,464 | 7/1969 | Levine | 70/456 |
| 4,037,439 | 7/1977 | Youd | 70/456 R |
| 4,306,433 | 12/1981 | Kelly | 70/456 |

*Primary Examiner*—Robert L. Wolfe
*Assistant Examiner*—Suzanne L. Dino
*Attorney, Agent, or Firm*—Jack W. Hayden

[57] ABSTRACT

A keyholder includes a flat plate of suitable material such as leather, plastic or other material which is provided with a plurality of spaced openings along one edge and a plurality of spaced openings along an opposed edge of the plate. Key hooks are provided in the openings for supporting keys therein. Flat strips extend across the front and back surface of the plate substantially midway between the openings in the pair of opposed edges, and suitable securing means secure the strips at spaced intervals on the front and back surface of the plate to form pockets on the front and back surface of the plate for receiving the keys therein.

1 Claim, 1 Drawing Sheet

KEYHOLDER

SUMMARY OF THE INVENTION

Various types of keyholders have been provided and are in use at the present time. The present invention provides an improved form of keyholder for supporting a maximum number of keys, while at the same time providing a holder which requires a minimum amount of space for storage and which can be readily stored in a shirt pocket, coat pocket or pants pocket without unduly bulging.

An object of the present invention is to provide a keyholder for supporting a plurality of keys and maintaining them substantially in a flat relationship for easy storage in a shirt or other clothes pocket without excessive bulging while still providing ready access to the keys for use.

Other objects and advantages of the present invention will become more readily apparent from a consideration of the following drawings and description.

DESCRIPTION OF THE PREFERRED EMBODIMENTS

Figure 1:
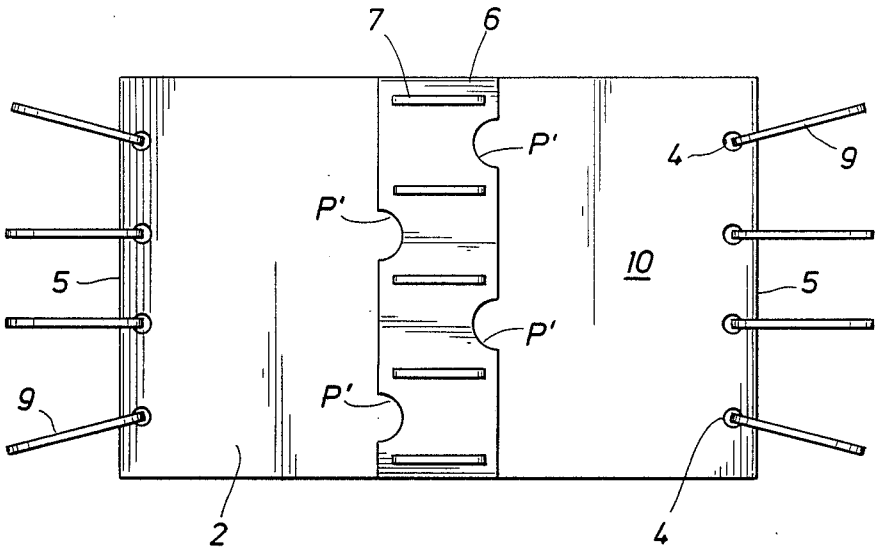
FIG. 1 is a plan view of the preferred embodiment of the keyholder of the present invention.

Attention is first directed to FIG. 1 of the drawings wherein a flat plate or strip of suitable material such as leather, plastic or other pliable material is provided with a plurality of edges. Openings 4 are provided adjacent or along a pair of edges and in the preferred arrangement the openings 4 are provided adjacent or along a pair of opposed edges designated at 5. As shown, the openings 4 at opposed edges are aligned longitudinally, but if desired or necessary the openings in one of the edges 5 may be offset longitudinally relative to its opposite opening in the other edge 5 to better accommodate or align the keys with the pockets P as will be described. Suitable keyhooks 9 are positioned in each of the openings 4 as shown for receiving and supporting keys represented in dotted line at 8 of FIG. 3 on the flat plate 2.

Figure 2:
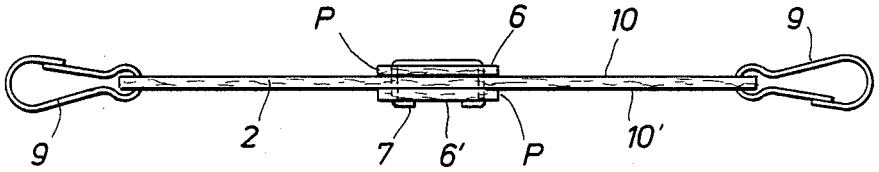
FIG. 2 is an edge view of the embodiment of the present invention shown in FIG. 1.

Flat, narrow strips 6 and 6' extend across the front and back surface 10 and 10' respectively of the plate 2 as better seen in FIG. 2 and are positioned substantially midway between the edges 5 or midway between the openings 4 along the opposed edges 5 of the plate 2. Suitable securing means referred to generally at 7 secure said strips 6 and 6' on the front and back surface at suitably spaced intervals to form the pockets P as better illustrated in FIGS. 1 and 3 of the drawings. The securing means 7 may assume any suitable form such as stitching or other suitable means and as illustrated are staples 7 which extend through the strip 6, plate 2 and strip 6'.

Figure 3:
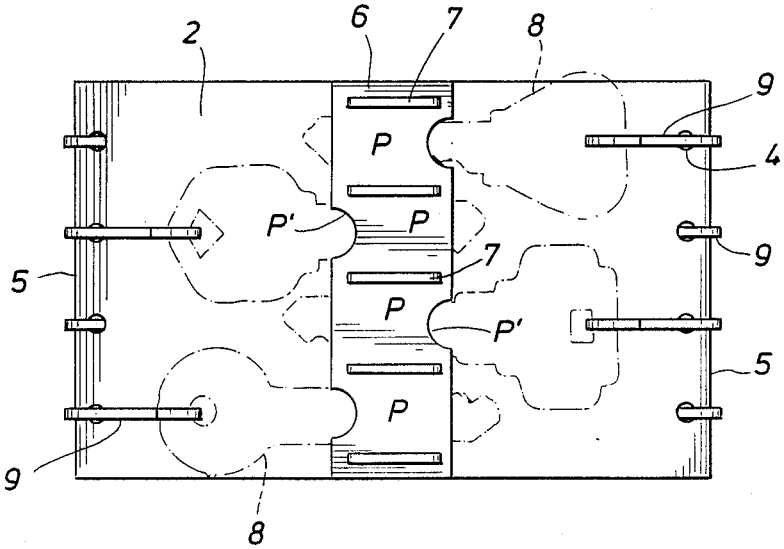
FIG. 3 is a plan view similar to FIG. 1 but illustrating in dotted line keys positioned on the hooks in the openings and the keys position in the pockets on one side of the holder. The keys on the other side are similarly positioned.

By spacing the staples 7 as shown, pockets P are provided between the staples, five of such staples being illustrated in FIGS. 1 and 3 to provide for pockets P, two on each side of the strip 6 on the front surface 10 for a total of four pockets on the front surface and pockets two on each side of the strip 6' on the bottom or back surface 10' of the strip 2 for a total of four pockets on the back surface 10'. If desired, all of the hooks may open in the same direction.

It will be noted that the pockets P include a cutaway P' in the edge of the strip facing the opening which will support the key that is to be received in the pocket P to make it easier to initially insert the end of the keys 8 into each of their respective pockets P.

The keyhooks 9, as illustrated in FIG. 2 are shown so that the hooks on opposed ends are arranged to open in opposite directions. For example, in FIGS. 2 and 3 the end keyhook 9 on the left edge 5 is illustrated as opening on the same side as front surface 10 and the keyhook 9 on the opposed or right hand edge 5 is shown as opening toward the bottom surface 10'. In some situations it may be desirable to have the keyhooks opening all in one direction on one edge 9 and in all in the other direction on the opposed edge 9 or all keyhooks opening in the same direction.

The foregoing arrangement provides a keyholder which, in the form of keyholder illustrated, enables eight keys to be supported on the keyholder and to be positioned and retained in the pockets in a substantially flat manner so that the keyholder and the supported keys may be received in a pocket or purse without unnecessarily bulging or occupying a substantial amount of space. It can be appreciated that if desired the plate may be of suitable extent to support any desired number of keys thereon.

The foregoing disclosure and description of the invention are illustrative and explanatory thereof, and various changes in size, shape and materials as well as in the details of the illustrated construction may be made without departing from the spirit of the invention.

What is claimed is:

1. A keyholder comprising:

a flat plate having opposed edges and a front and back surface;

a plurality of spaced openings adjacent a pair of said opposed edges of said plate;

keyhooks in said openings for supporting keys therein;

strips extending across the front and back surface of said plate substantially midway between the openings in said pair of opposed edges;

securing means securing said strips at spaced intervals to said front and back surfaces to form pockets for receiving keys therein; and said openings along said opposed edges being aligned alternately with a pocket on the front and back surfaces of said keyholder.

* * * * *